US007931036B1

(12) United States Patent
Hobbs

(10) Patent No.: US 7,931,036 B1
(45) Date of Patent: Apr. 26, 2011

(54) IN-USE ADJUSTABLE WALKER

(76) Inventor: Chad Eric Hobbs, Athens, AL (US)

( * ) Notice: Subject to any disclaimer, the term of this patent is extended or adjusted under 35 U.S.C. 154(b) by 0 days.

(21) Appl. No.: 12/386,424

(22) Filed: Apr. 17, 2009

Related U.S. Application Data

(60) Provisional application No. 61/045,789, filed on Apr. 17, 2008.

(51) Int. Cl.
*A61H 3/04* (2006.01)

(52) U.S. Cl. ..... 135/67; 135/85; 482/68

(58) Field of Classification Search ..... 135/65, 135/67, 85, 77, 69; 482/52, 60–62, 66–68; 280/304.1
See application file for complete search history.

(56) References Cited

U.S. PATENT DOCUMENTS 4,180,086 A * 12/1979 Thomas ..... 135/67
4,461,471 A * 7/1984 Brastow ..... 482/68
4,995,412 A * 2/1991 Hirn et al. ..... 135/67
5,275,187 A * 1/1994 Davis ..... 135/67
5,433,235 A * 7/1995 Miric et al. ..... 135/67
5,649,558 A * 7/1997 Richard ..... 135/67
5,702,326 A * 12/1997 Renteria ..... 482/68
6,003,532 A * 12/1999 Pi ..... 135/67
6,099,002 A * 8/2000 Uchiyama ..... 280/87.021
6,886,575 B2 * 5/2005 Diamond ..... 135/74
7,373,942 B1 * 5/2008 Yeager ..... 135/67
7,506,657 B2 * 3/2009 Hsiao ..... 135/67
2008/0163913 A1 * 7/2008 Hsiao ..... 135/67

* cited by examiner

*Primary Examiner* — Winnie Yip
(74) *Attorney, Agent, or Firm* — Mark Clodfelter

(57) ABSTRACT

A walker is disclosed that may be adjusted in width during use for allowing the user to pass safely through narrow doorways or passageways. Walkers of the present invention have cross-bars at a front thereof constructed of telescoping tubing and locking/unlocking mechanisms. During use, the telescoping tubes may be unlocked so that a smaller tube may be moved into a larger tube, reducing a width of the walker. In other embodiments, a lead screw assembly may be rotated in order to reduce width of the walker. In yet other embodiments the walker may be automatically increased or decreased in width responsive to the tubes being unlocked.

13 Claims, 16 Drawing Sheets

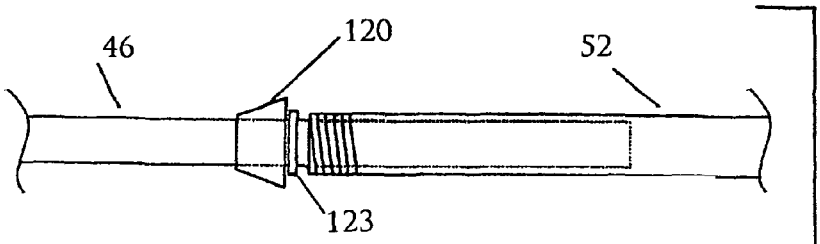
FIG. 8
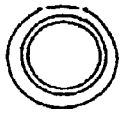
FIG. 8(A)
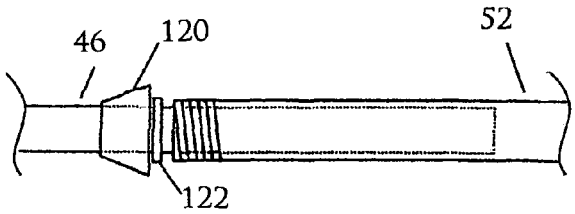
FIG. 8(B)
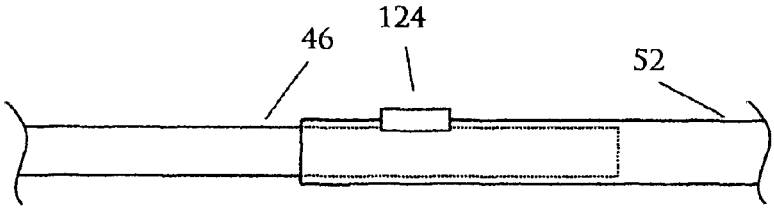
FIG. 9
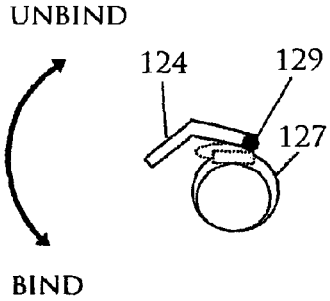
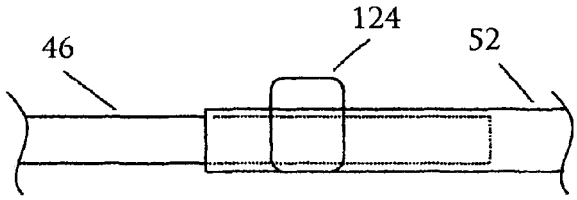
FIG. 9(B)
FIG. 9(A)

IN-USE ADJUSTABLE WALKER

CROSS REFERENCE TO RELATED APPLICATIONS

This application claims the benefit of provisional application No. 61/045,789, filed Apr. 17, 2008.

FIELD OF THE INVENTION

This invention relates generally to devices that assist an individual with a disability or elderly person while walking, and particularly to a walker that may be reduced in width during use in order for the walker to be used while passing through a narrow doorway or other narrow passage.

BACKGROUND OF THE INVENTION

In general, walkers and walker-type devices are a necessity for many individuals to ambulate efficiently, effectively, and safely. Individuals become dependent on these devices for a number of reasons: failing strength, poor balance, birth defects, surgeries, and other afflictions associated with growing old. With an increasing demand due to an increasing number of the population becoming older, there are products available to meet the needs of elderly individuals who need assistance when walking. Some of the more common products are walkers, rolling walkers, hemi-walkers, canes, quad canes, and the like. For the most part, this array of products meets the needs of most people who need assistance while walking. However, there are certain populations that are not being well served by the current market offerings. For instance, some individuals that live in homes or visit places on a regular occasion that have narrow (less than 24") doors, hallways or other narrow passageways. These individuals would benefit from having a walker that is easily and readily adjustable in width during use in order to easily pass through these narrow doors and passageways of older homes.

Such narrow passages and doorways have always been a problem for walker-dependent individuals. The traditional method of dealing with such a problem has been to leave the walker behind, which is an obviously dangerous situation, or to attempt to maneuver through the opening sideways or with the walker partially folded, a similarly very dangerous maneuver in which many individuals fall. This is an unnatural movement, in addition to using the walker in a way that it was not designed to be used.

Three basic walker designs of the prior art are currently available; walker types 1, 2 & 3, as shown in FIGS. 1, 1*a*, 2, 2*a* and 3, 3*a*, respectively. All of these walkers have sides that are foldable so that the walker is generally flat for storage and convenient transport. Walker type 1 (FIGS. 1, 1*a*) offers a front, rigid lower crossbar 1 having ends that terminate with sleeves 2, 2' that allow a respective front vertical member 3, 3' to rotate within the sleeve so that the sides may fold generally flat against or adjacent to the front crossbars. A second, upper crossbar 4 has integrated therewith a latch arrangement 5 that locks and unlocks the sides so they may folded against or adjacent to the crossbars.

Walker type 2 (FIGS. 2, 2*a*) offers 2 front crossbars 20, 22 that integrate hinges and locks 24, 26 on ends of the top crossbar, and which must be unlocked simultaneously so that the sides may be folded inward. The lower crossbar 22 is also rigid, and also is fitted with sleeves as shown in FIG. 1 for allowing the vertical front side members to rotate within the sleeves. Walker type 3 (FIGS. 3, 3*a*) offers only a single, rigid front crossbar 24, with hinges and locking mechanisms 25 on ends of the sides in addition to sleeves for allowing the vertical side members to rotate with respect to the crossbar, folding the walker flat. In all of these walkers, at least one front crossbar is rigid, preventing the walker from being reduced in width.

BRIEF DESCRIPTION OF THE DRAWINGS

FIGS. 8, 8*a*, 8*b* diagrammatically illustrate a fifth locking/unlocking adjustment mechanism of my new walker.

FIGS. 9, 9*a*, 9*b* diagrammatically illustrate a sixth locking/unlocking adjustment mechanism of my new walker.

DETAILED DESCRIPTION OF THE DRAWINGS

Figure 1:
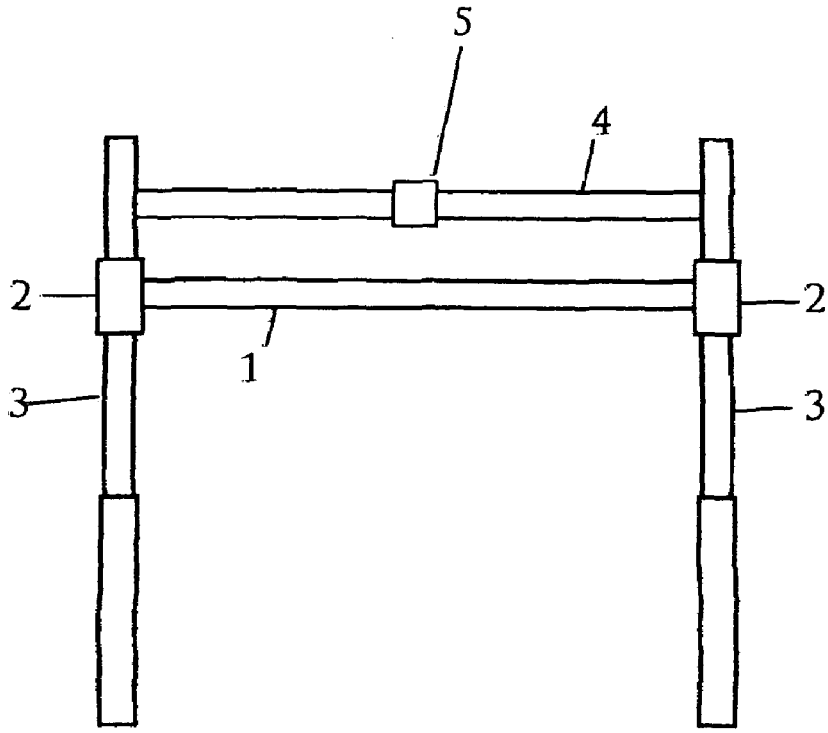
FIG. 1 PRIOR ART
FIGS. 1, 1*a* diagrammatically illustrate a first type walker of the prior art.
Figure 1A:
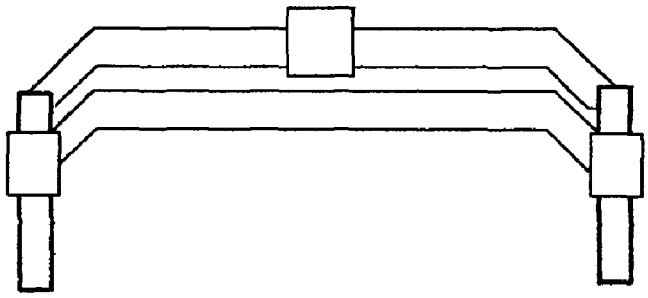
FIG. 1(A) PRIOR ART
Figure 2:
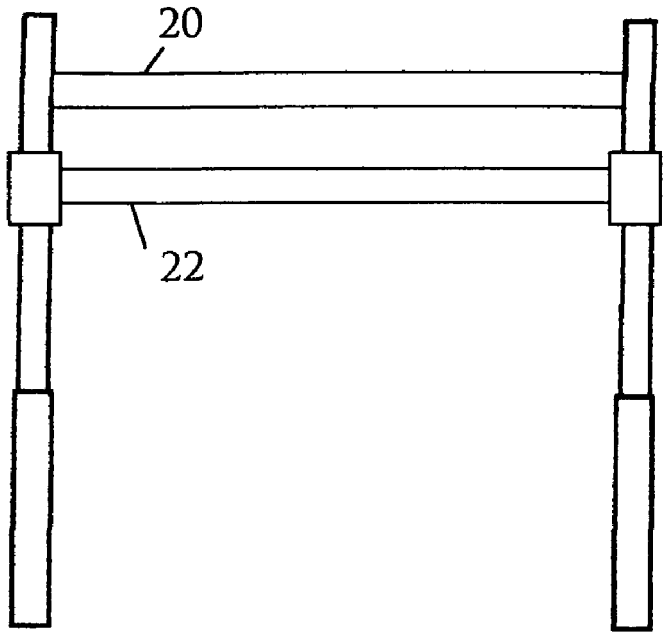
FIG. 2 PRIOR ART
FIGS. 2, 2*a* diagrammatically illustrate a second type walker of the prior art.
Figure 2A:
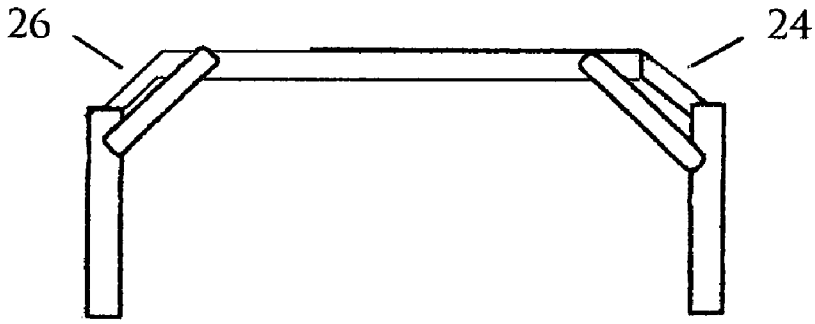
FIG. 2(A) PRIOR ART
Figure 3:
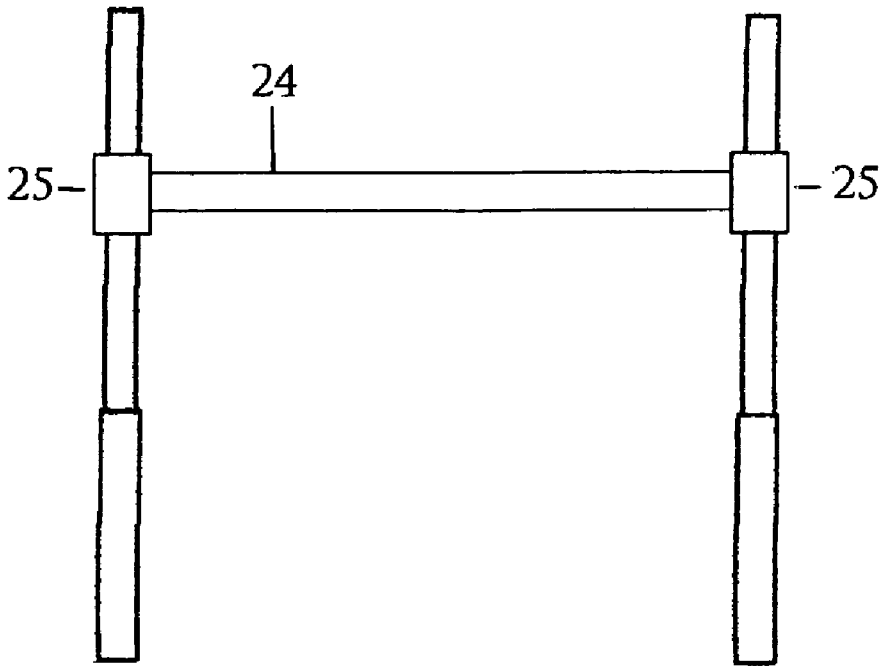
FIG. 3 PRIOR ART
FIGS. 3, 3*a* diagrammatically illustrate a third walker type of the prior art.
Figure 3A:
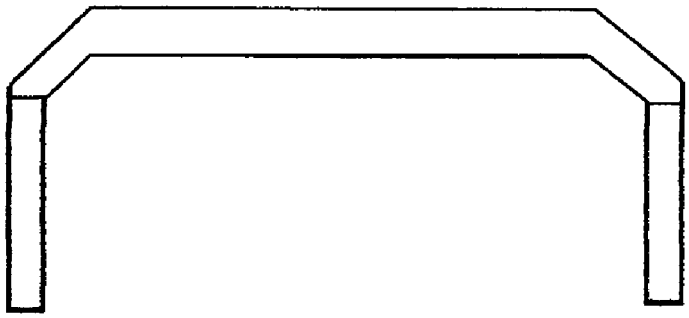
FIG. 3(A) PRIOR ART

A walker capable of for in-use adjustability to allow a user to adjust width of the walker to navigate narrow passageways or narrow doorways is disclosed. My proposed walker allows the user to safely adjust a width of the walker during use in order to use the walker in its normal manner while passing through narrow doors, hallways and other passageways that are narrower than the walker at its normal width. The walker may initially be at its normal width, typically that of a standard walker, which is around 19-21 inches or so, but allows for a decreased width adjustment of 3"-4", which makes the total adjusted width of the walker 16-17" or so. This narrower width allows a user who needs the use of a walker to navigate easily and safely through narrow passages, such as through 20" bathroom doors and narrow hallways such as those found in older homes, using the walker as it is intended to be used. Additionally, my new walker has the advantage of providing the same stability of a traditional walker with its standard width, but also has the same stability for safe passage through the narrow doors or hallways at its reduced width. Once passage is complete, the walker can then be safely and selectively widened by the user (without losing use of the walker) to its original width. Such a walker offers stability and mobility in all the aforementioned situations, which is very important in the lives of those that depend on walkers.

Adjustment and Lock Mechanisms

My new walker is specifically directed to a modification of the crossbars attached to sides of the walker wherein the crossbars are variable in length to allow adjustment of width of the walker. The attachment of ends of my crossbars may still be such as to allow folding of the sides, as is currently the case with available walkers. While the drawings herein show my new crossbars, it is to be understood that ends of these crossbars are attached to sides of a walker. The various locking and adjustment mechanisms of Applicant's walkers will now be discussed. It is emphasized that all of my mechanisms allow a user to easily and safely reduce width of a walker while using the walker and without temporarily losing the use of the walker while it is being adjusted. Most of my walkers are constructed having a pair of front tubular crossbars that are fabricated in two sections or members, one section or member attached to one side of the walker and the other section or member attached to the other side of the walker. The tubes are sized so that one tube telescopes within the other, as will be further explained. However, these crossbar sections or members may also be constructed of sturdy strips or bars each having a slot therein, with at least one fastener that is tightenable or loosenable as desired passing through each of the slots. When loosened, the bars are movable longitudinally with respect to each other to widen or narrow the walker. In addition, angle iron, U-shaped channel iron or the like may also be used as the sections or members attached to respective sides of the walker. Further, where there is an upper and lower crossbar having members constructed of a bar, angle iron, channel iron or the like, there may be a single central bracket extending between the upper crossbar and lower crossbar that is also configured as a clamp that clamps the respective sections or members together at the desired width of the walker.

Figure 4:
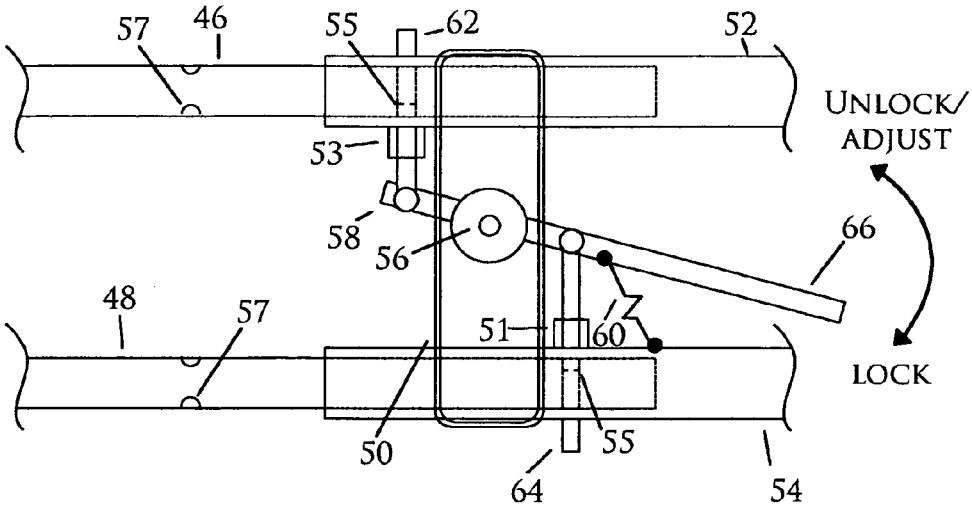
FIGS. 4, 4*a*, 4*b* diagrammatically illustrate a first locking/unlocking adjustment mechanism of my new walker.
Figure 4A:
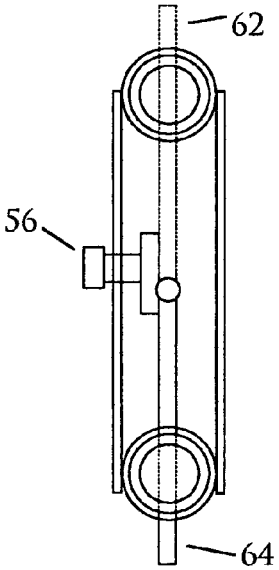
Figure 4B:
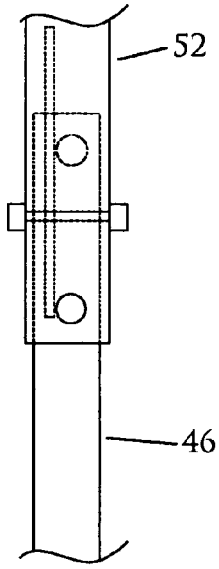

FIGS. 4, 4*a* and 4*b* show a locking mechanism where there are two inner pairs of telescoping tubes 46, 48, and outer tubes 52, 54 respectively across the front of a walker, such as shown in walker types 1 and 2. At least one frame plate or bracket 50 extends vertically between the outer tubes 52, 54, which frame plate 50 rotatably supporting an axle or pivot point 56 connected to a lever arm 58 biased as shown by a tension spring 60. Locking pins 62, 64 may extend through openings in both tubes 46, 48 and 52, 54 as shown so as to lock the cross bars in place at a selected width when their respective openings are aligned. A handle 66, which may be an extension of lever arm 58, may be operated in an upward direction to retract both locking pins 62, 64 simultaneously and release the telescoping tubes 46, 48 so that they may be telescopingly moved inside outer tubes 52, 54. A second set of openings 57 in each pair of tubes 46, 48, and movable into registry with corresponding openings in tubes 52, 54 may be provided to lock the tubes in the narrowed position, although in some instances the walker may be used without locking the tubes together in the narrowed position. Here, such a narrowed position is a temporary orientation, and after a user has passed the doorway or passageway the walker may be restored and locked at its wider width. Alternately, where suitable, the narrowed configuration of the walker may be used regularly. Guides 51, 53 coaxial with openings in tubes 52, 54 may be provided to prevent pins 62, 64 from becoming misaligned from their respective openings when the pins are retracted completely out of their openings.

In use, a user, when encountering a narrow passageway or doorway requiring the walker to be adjusted to a narrower configuration, and while stabilizing oneself by holding on to the walker, need only operate handle 66 upward against the bias of spring 60 to withdraw pins 62, 64 from openings in the tubes and release the locking engagement of tubes 46, 48 with tubes 52, 54. This allows and telescopingly slide the two inner tubes into the outer tubes 52, 54 to reduce the walker to its narrower width, and where openings at the narrower width are provided, such as openings 57, engage pins 62, 64 with openings 57 where necessary. When the walker is to be restored to its original size, the handle 66 may again be operated upward against the bias of spring 60, withdrawing pins 62, 64 from the tubes, and the telescoping tubes moved outward until pins 62, 64 register with their respective openings at the wider width, locking the telescoping tubes in place. While operating the release mechanism to both narrow and expand the walker, the operator is always stabilized as one or both his/her hands may remain on the supporting portions of the walker.

While pins 62, 64 are shown as extending through both sides of respective tubes, pins 62, 64 may be shortened so as to extend only through a single opening in tubes 46, 52 and 48, 54, as shown by dashed lines 55. In this instance where shorter pins 62, 64 are used, a stop having a shoulder (not shown) may be incorporated on plate or plates 50, and against which lever 58 abuts, to prevent the pins from being withdrawn from guides 51.

Figure 5:
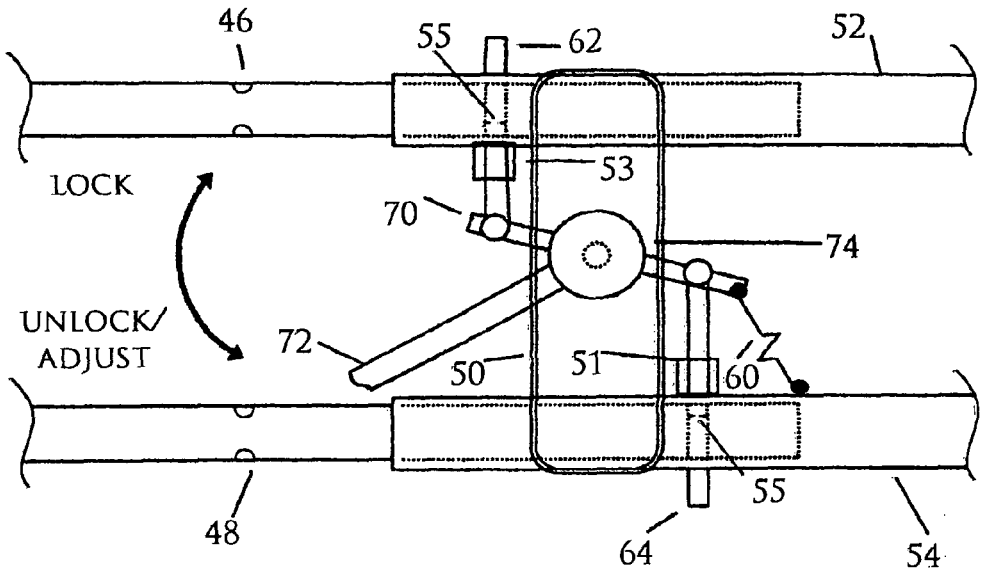
FIGS. 5, 5*a*, 5*b* diagrammatically illustrate a second locking/unlocking adjustment mechanism of my new walker.
Figure 5A:
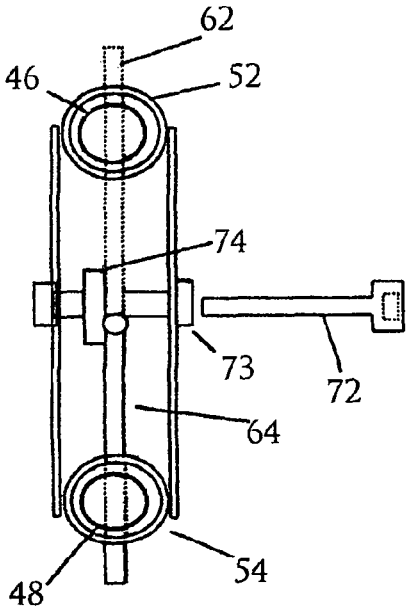
Figure 5B:
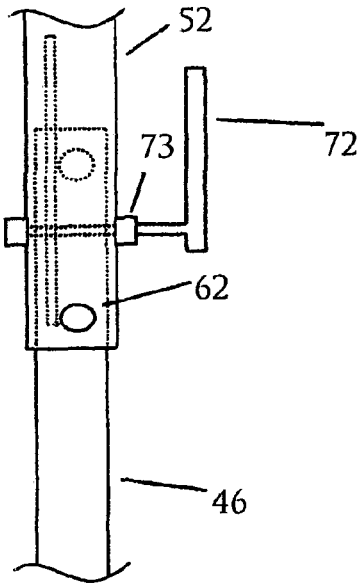

FIGS. 5, 5*a*, 5*b* shows a similar arrangement to that of FIG. 4, and wherein there is a lever arm 70 with lock pins 62 and 64 that engage aligned holes in telescoping bars or rods 46, 48 and 52, 54, respectively. In this embodiment, adjusting handle 72 may be a key-type handle (FIG. 5*a*) that fits into a socket 73 in order to rotate a hub 74 counterclockwise against the bias of spring 60, with lever arm 70 attached to hub 74. Handle 72 may be attached to the walker by a cord or the like so as to not become lost when not in use. When hub 74 is rotated, locking pins 62, 64 are withdrawn from their openings in telescoping bars or rods 46, 48 and 52, 54, respectively, allowing width of the walker to be reduced as described above. As noted above, a stop (not shown) may be provided on plates 50 and/or hub 74 to abut against lever 70 or handle 72 prevent it from being rotated so far that the pins completely retract from guides 51, 53. In addition, pins 62, 64 may be shortened so as to extend only through openings in one side of tubes 46, 48 and 52, 54.

Figure 6:
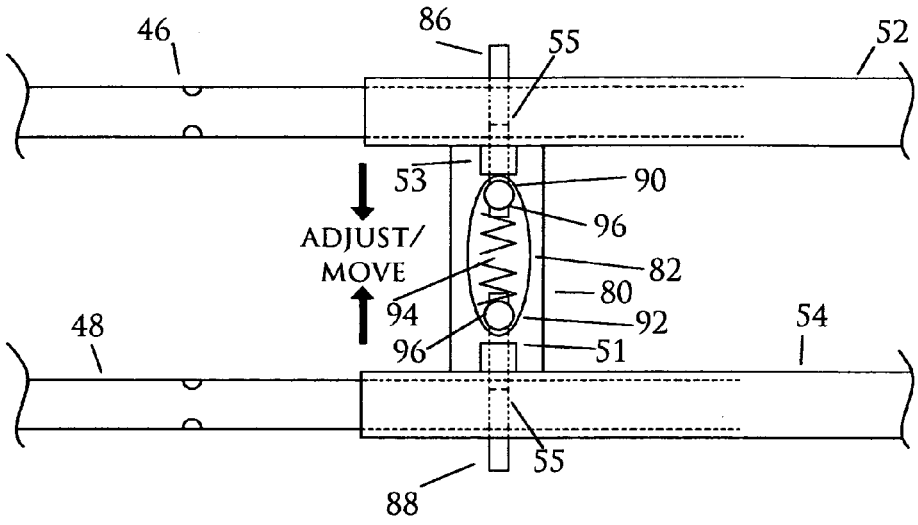
FIGS. 6, 6*a*, 6*b* diagrammatically illustrate a third locking/unlocking adjustment mechanism of my new walker.
Figure 6A:
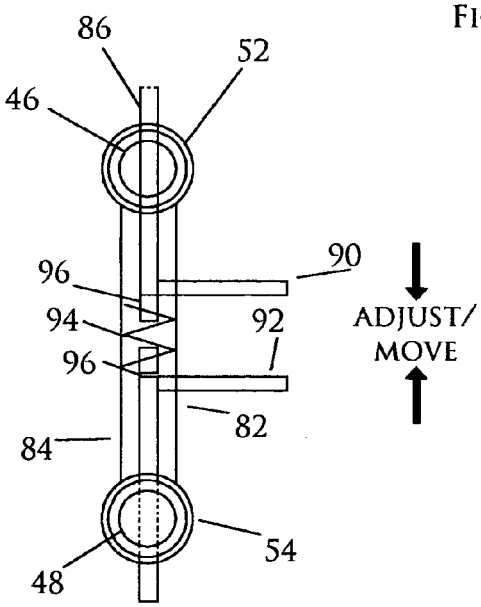
Figure 6B:
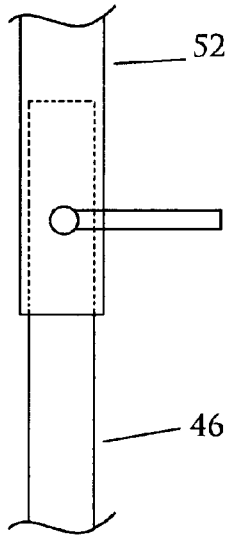

FIGS. 6, 6*a*, 6*b* shows a locking arrangement wherein a bracket 80 extends between tubes 52, 54, bracket 80 having a slot 82 therein. A second bracket 84 (FIG. 6*a*) may be used to provide a space between the brackets within which two L-shaped locking pins 86, 88 are fitted. In another embodiment, rather than brackets 80, 84, the locking pins 86, 88 may be disposed in a tube between the bars of the walker, with a slot 82 provided in the tube as shown in FIG. 6. In operation, the horizontal portions 90, 92 of locking pins 86, 88 form handles that when squeezed together against the bias of a compression spring 94 located between locking pins 86, 88, withdraw pins 86, 88 from openings in telescoping tubes 46, 48 and 52, 54, respectively so that the walker may be narrowed by sliding tubes 46, 48 into tubes 52, 54. A vertical extension or stub 96 on each of locking pins 86, 88 at an intersection of the locking pin portion and the handle portion forms a stub about which each end of spring 94 is fitted in order to hold the spring in place. A stop (not shown) may be configured for preventing each of the locking pins from being withdrawn completely from tubes 52, 54 and/or guides 51, 53 may be provided to prevent the pins from becoming misaligned when retracted. As described above, pins 86, 88 may be shortened, as indicated by dashed line 55, so as to extend through openings only in one side of tubes 46, 48 and 52, 54. Likewise, internal guides 51, 53 may be provided to stabilize movement of pins 52, 54. As stated, when handles 90, 92 are squeezed together, locking pins 86, 88 are retracted from at least interior tubes 46, 48 to allow them to be pushed into tubes 52, 54 and narrow the width of the walker.

Figure 7:
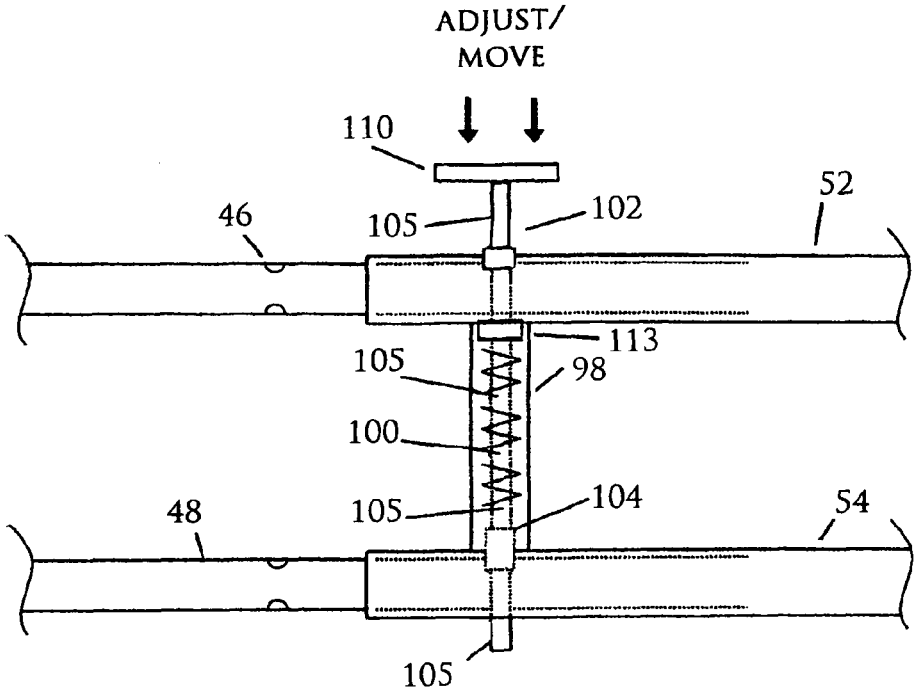
FIGS. 7, 7*a*, 7*b* diagrammatically illustrate a fourth locking/unlocking adjustment mechanism of my new walker.
Figure 7A:
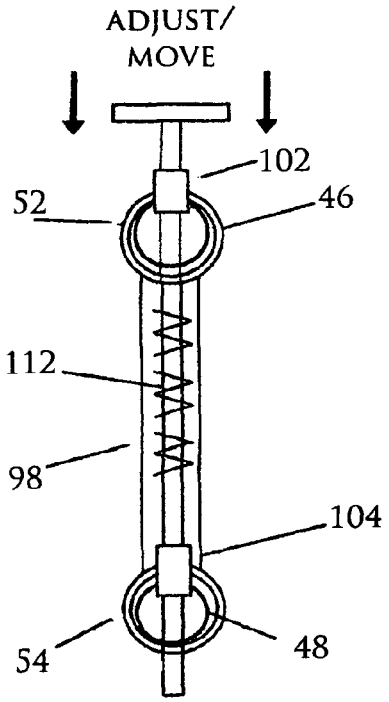
Figure 7B:
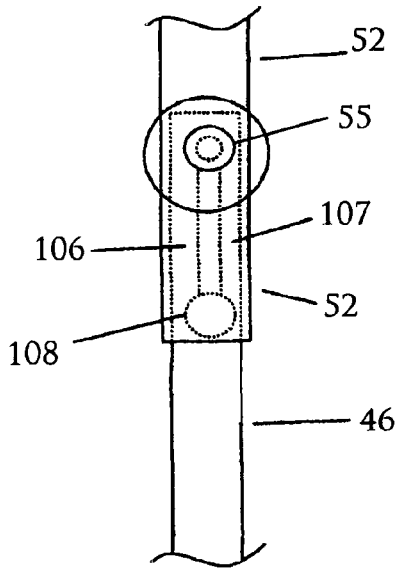

FIGS. 7, 7*a* and 7*b* shows a locking arrangement wherein a tubular portion 98 extends between tubes 52, 54, and within which a single locking pin 100 engages openings in both tubes 46, 48 and 52, 54. In some embodiments, tubular portion 98 may be omitted. Pin 100 is provided with two enlarged regions 102, 104, and tubes 46, 48 are each provided with a slot 106 communicating with an enlarged opening 108 (FIG. 7*b*, shown with walker at its expanded width). Tubes 52, 54 are each provided with a single enlarged opening 109 for receiving a respective enlarged region 102, 104 of the locking pin. Each enlarged opening 108, 109 receives a respective enlarged region 102, 104 of the locking pin in order to lock tubes 46, 48 and 52, 54, respectively, in place. A disk 110 (or T-handle) is attached to one end of locking pin 100, and a compression spring 112 is positioned as shown about locking pin 100, which compression spring bearing against a collar 113 and a side of tube 54. Collar 113 also provides a stop to orient the locking pin at a point where the enlarged regions are positioned in the enlarged openings. With this construction, locking pin 100 may be pushed inward to disengage enlarged portions 102, 104 from respective enlarged openings 108 of the slots in the upper and lower tubes so that a narrower portion 105 of the locking pin may enter a narrower portion 107 of slots 106, allowing tubes 46, 48 to be pushed into tubes 52, 54, thus reducing a width of the walker.

FIGS. 8, 8*a* and 8*b* shows a compression fitting 120, 122 locking each of tubes 52 (54 not shown) to respective tubes 46 (48 not shown), these compression fittings each having an interior tapered surface configured to compress a flexible plastic or other polymer ring or the like 123 between an interior of the tapered surface of the compression fitting and sides of a respective one of tubes 46, 48. This compression of members 123 develops a frictional engagement between tubes 46, 52 and locks them together.

FIGS. 9, 9*a* and 9*b* shows a binding mechanism 124 for locking tubes 52, 54 and 46, 48, respectively, together. This binding mechanism may comprise a compression band 127 around outer tube 52 (54), and a lever 124 that operates a cam 129 that tightens band 127 and compresses outer tube 52 (54) against the inner tube 46 (48), locking the tubes together. Each of these mechanisms may be operated by a user with one hand while using the other hand to stabilize oneself with the walker.

Figure 10:
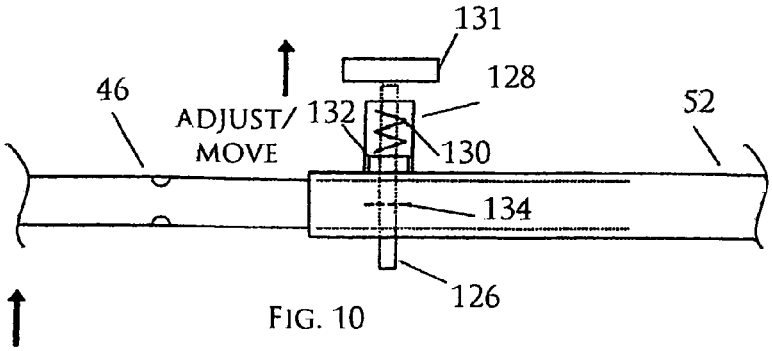
FIGS. 10, 10*a*, 10*b* diagrammatically illustrate a seventh locking/unlocking adjustment mechanism of my new walker.
Figure 10A:
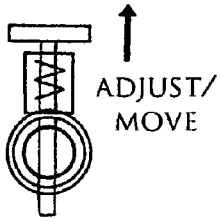
Figure 10B:
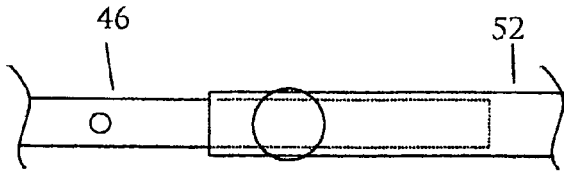

FIGS. 10, 10*a*, 10*b* shows a locking pin 126 engaging one of tubes 46, 48 and tubes 52, 54, respectively, pin 126 supported by a housing 128 within which a compression spring 130 is fitted around pin 126. Pin 126 engages openings in both tubes 46, 52 in order to lock them together. A collar 132 is fitted to pin 126 so that when pin 126 is pulled outwardly, spring 130 is compressed between collar 132 and an outermost interior end of housing 128. Housing 128 and a portion of pin 126 therein is of a length so that the end of locking pin 126 is retracted from tube 46 when pin 126 is pulled outward to its maximum extent, thereby allowing tube 46 to be pushed into tube 52, reducing width of the walker. A disk 131 attached as shown to pin 126 is provided for the user to conveniently pull locking pin 126 out of tube 46, unlocking the tubes and allowing the inner tube to be pushed into the outer tube. Alternately, pin 126 may extend only into a single, upper opening through each of tubes 46, 52 (tubes 48, 54 not shown) as shown by dashed line 134. In this embodiment, pin 126 would only need to be retracted a short distance in order to clear the opening in tube 46 (48) for reducing width of the walker. Housing 128 may also incorporate a guide coaxial with the opening in tube 52 so that pin 126 does not become misaligned from an opening in outer tube 52 when retracted.

Figure 11:
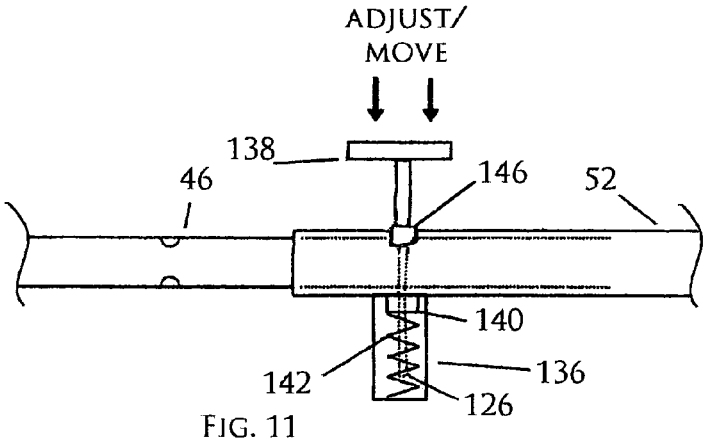
FIGS. 11, 11*a*, 11*b* diagrammatically illustrate an eighth locking/unlocking adjustment mechanism of my new walker.
Figure 11A:
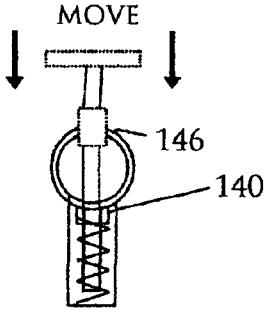
Figure 11B:
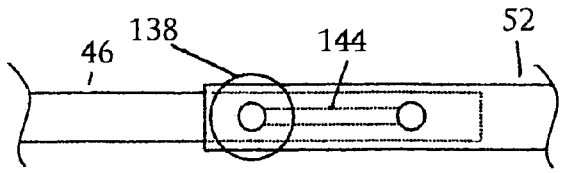

In a similar embodiment as shown in FIGS. 11, 11*a*, 11*b*, a housing 136 is positioned on a side of one of tubes 52, 54 opposite a handle or disk 138 connected to pin 126, the pin 126 having a collar 140 that bears against a compression spring 142 and an outer inner end of housing 136. A slot and opening arrangement is provided wherein a slot 144 (FIG. 11*b*, showing walker adjusted to a narrower width) in tube 46 similar to that shown in FIG. 7 allows an enlarged portion 146 of the locking pin, normally engaged as shown in an enlarged opening in both tubes 46, 52, to be pushed into tube 46, allowing a narrower part of pin 126 to enter slot 144, in turn allowing tube 46 to be pushed into tube 52, thereby narrowing width of the walker. A disk 138 is attached as shown to an end of pin 126 for allowing a user to push against, pushing the pin out of locking engagement of the two tubes.

Figure 12:
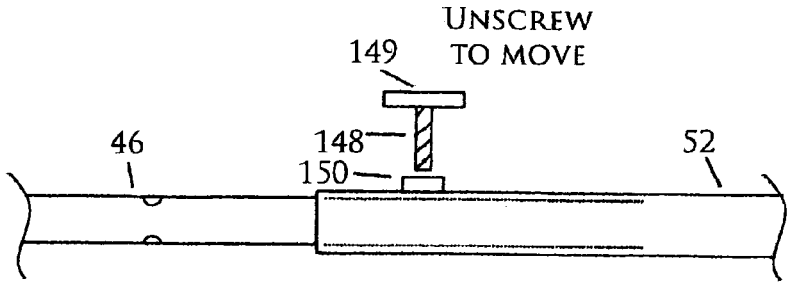
FIGS. 12, 12*a*, 12*b* diagrammatically illustrate a ninth locking/unlocking adjustment mechanism of my new walker.
Figure 12A:
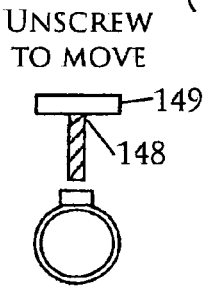
Figure 12B:
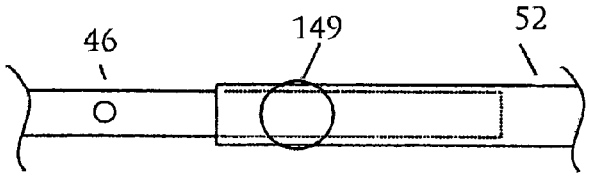

FIGS. 12, 12*a*, 12*b* shows a threaded adjustment pin 148 that engages a threaded portion, such as a nut 150 welded or otherwise attached to tube 52, and which may extend through openings in both tubes 46, 52, locking them together. Pin 148 may be configured having a disk (or T-handle) 149 that may be easily gripped and turned by a user. In this embodiment, simply removing threaded pin 148 allows tube 46 to be pushed into tube 52, narrowing width of the walker. Alternately, tube 46 may be configured having one or more dimples or depressions for receiving an end of threaded pin 148, or threaded pin 148 may simply be tightened against tube 52, binding them together.

Figure 13:
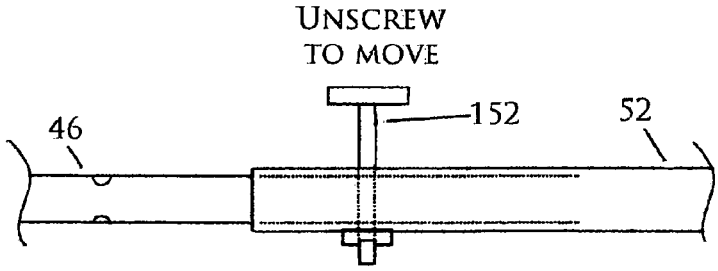
FIGS. 13, 13*a*, 13*b* diagrammatically illustrate a tenth locking/unlocking adjustment mechanism of my new walker.
Figure 13A:
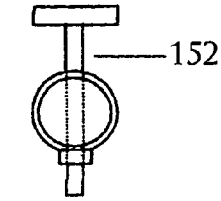
Figure 13B:
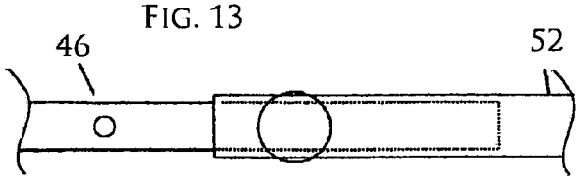

In a variation of this embodiment, and as shown in FIGS. 13, 13*a*, 13*b* a threaded pin 152 is shown, which pin extending completely through openings in tubes 46, 52 to engage threads of a nut on an opposite side of tube 52. Again, simply unscrewing and withdrawing pin 152 from tubes 46, 52 allows tube 46 to be pushed into tube 52, narrowing width of the walker. An internal guide may be used to facilitate alignment of pin 152 with the threaded nut, or an end of the pin may be pointed or otherwise configured so that a user may easily fit the pin into the threaded opening of the nut. In the embodiments of FIGS. 12 and 13, the pin may be attached to the walker by a cord or lanyard so as to prevent the pin from becoming lost when not in use.

Figure 14:
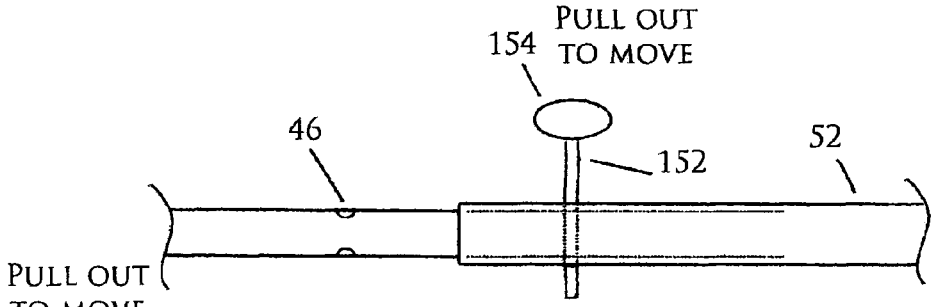
FIGS. 14, 14*a*, 14*b* diagrammatically illustrate an eleventh locking/unlocking adjustment mechanism of my new walker.
Figure 14A:
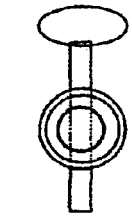
Figure 14B:
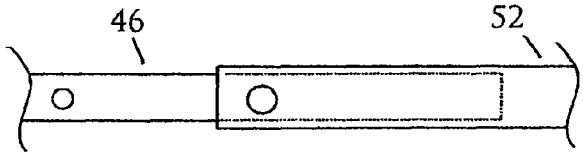

FIGS. 14, 14*a*, 14*b* shows an unthreaded pin 152 extending through tubes 46, 52, locking the tubes together. Pin 152 may have an enlarged head 154 so as to be gripped easily and retracted from tubes 46, 52. In this embodiment, pin 152 is held in place by gravity, and may be attached to a walker by a cord, lanyard or the like so as to not become lost when removed.

Figure 15:
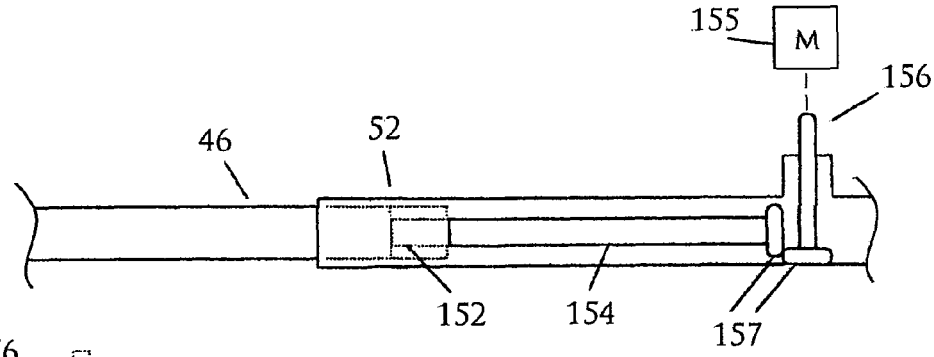
FIGS. 15, 15*a*, 15*b* diagrammatically illustrate a twelfth locking/unlocking adjustment mechanism of my new walker.
Figure 15A:
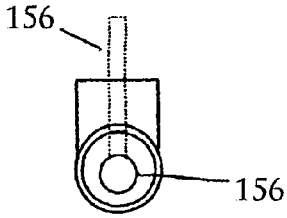
Figure 15B:
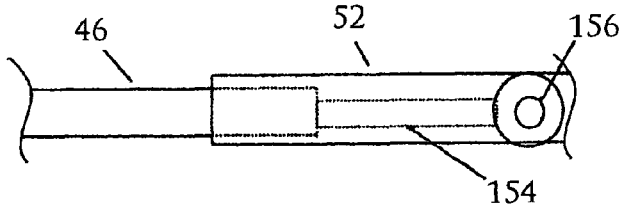

FIGS. 15, 15*a*, 15*b* shows a version wherein an end of rod 46 is provided with a threaded opening 152 in which a threaded rod or lead screw 154 is engaged. A set of bevel gears 157 or the like may be provided to allow connection of a hand crank (not shown) or motor 155, which may be battery powered, to a shaft 156 in order to provide a rotational force to lead screw 154, causing tube 46 to be moved into and out of tube 52. Alternately, instead of bevel gears, a motor, which may incorporate a gear reduction, may be coupled directly to an end of lead screw 154, and driven by batteries incorporated in or with the walker frame. This embodiment with a motor is advantageous in that all a user has to do is operate a switch to activate a motor, with the walker locked at a point where the motor stops without the user doing anything to lock the telescoping tubes. Such a locking action is due to the difficulty of back driving a lead screw attached to a motor.

Figure 16:
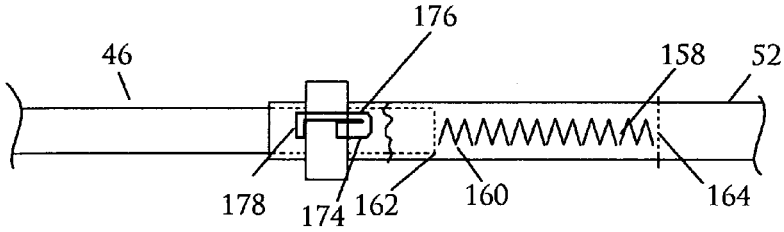
FIGS. 16, 16*a*, 16*b* diagrammatically illustrate a thirteenth locking/unlocking adjustment mechanism of my new walker.
Figure 16A:
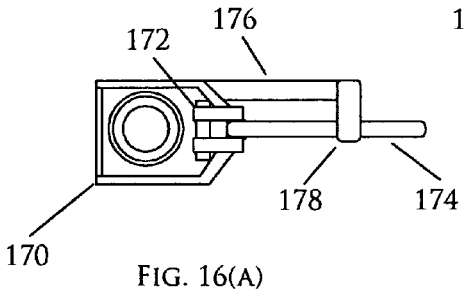
Figure 16B:
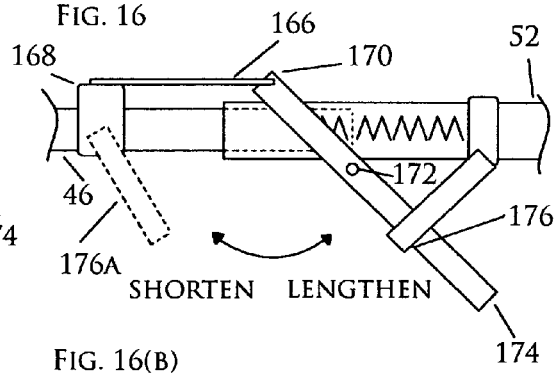

FIGS. 16, 16*a*, 16*b* shows, a single crossbar having telescoping tubes 46, 52, with a tension spring 158 within tube 52, spring 158 attached at one end 160 to an end 162 of tube 46, and at the other end to a shoulder, pin or the like. 164 (dashed lines) within tube 52. A strength of spring 158 is selected so that it would urge the tubes together while not being so strong that it could injure someone if the handle catch became inadvertently disengaged, as will be explained. With this construction, spring 158 is stretched between an end of tube 46 and shoulder or pin 164. A link 166 extends between an attachment 168 on tube 46 and an end of a forked lever 170 (FIG. 17*a*), which lever 170 pivoting at a pivot point 172. Link 166 may be loosely attached at 168 so as not to bend the link when the lever is pivoted. Pivot point 172 may be constructed as shown in FIG. 17*a* with a tab (not shown) attached to tube 52, and a fork depending as shown from the interior of forked lever 170. An opposite end of lever 170 forms a handle 174, and a latch or clip 176 attached to tube 46, as by a tab attached to tube 46 and a fastener extending through the tab and end of latch 176. Latch 176 is provided with a catch comprising a lip 178 (FIGS. 16, 16*a*) that holds handle 174 in place against the bias of spring 158. In this embodiment, the walker is held at its normal width by handle 174 engaging lip 178 of latch 176. When it is desired to narrow the walker, handle 174 or latch 176 may be moved to disengage handle 174 from lip 178, allowing the handle to be moved to the left under the bias of spring 158, allowing spring 158 to draw tube 46 within tube 52. To restore the walker to its normal width, handle 174 is moved to the right and latched, which extends tube 46 from tube 52 against the bias of spring 158. Alternately, to prevent potentially dangerous inadvertent and accidental release of handle 174 during normal use of the walker, spring 158 may be a compression spring biased between a shoulder or end 160 of tubes 46 and a pin or shoulder 164 in tube 52, with a latch 176*a* mounted on tube 46 as shown by dashed lines. With this construction, handle 174 would only be lightly or unbiased with the walker at its normal width, and under the bias of spring 158 only when the walker is narrowed, thus reducing possibility of injury due to inadvertent release of handle 174. In another alternate embodiment, handle 174 may be configured to be parallel with the crossbar and biased by spring 158, and held in place in such parallel position by a movable ring around the crossbar. The ring would be moved to release the handle as shown in FIG. 16*b* when it is desired to reduce the width of the walker.

Figure 17:
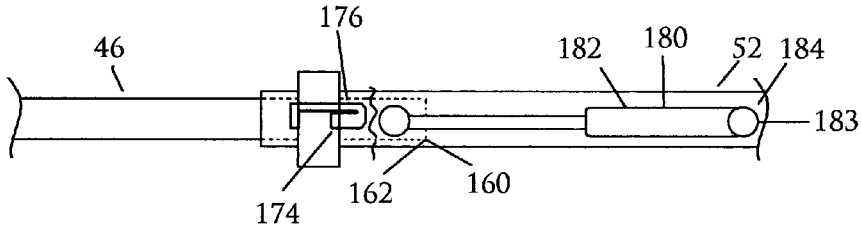
FIGS. 17, 17*a*, 17*b* diagrammatically illustrate a fourteenth locking/unlocking adjustment mechanism of my new walker.
Figure 17A:
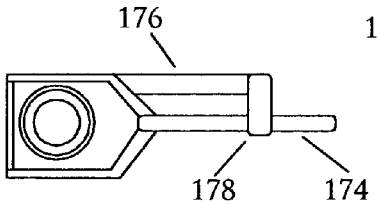
Figure 17B:
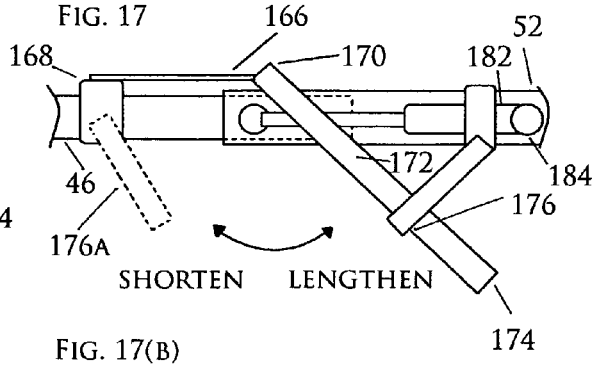

FIGS. 17, 17*a*, 17*b* shows a variation of the embodiment shown in FIG. 16, except spring 164 is replaced by a hydraulic lift cylinder 180 similar to that found in automobile rear hatches, except providing less force. A rear 184 of body 182 of cylinder 180 may be attached by a pin 183 as shown in FIG. 17 within tube 52 so that handle 174 would engage latch 176 against the bias of cylinder 180 with the walker at its normal width, or the cylinder may be reversed so that handle 174 would be relaxed with the walker at its normal width, and engaged with a latch 176*a* (dashed lines) against the bias of cylinder 180 with the walker narrowed to its narrow width. As described above, the handle may be configured so as to be parallel with the crossbar when biased by the cylinder, and a movable ring around the crossbar configured to be movable over the handle to hold the handle in place parallel to the crossbar when biased by cylinder 180.

Figure 18:
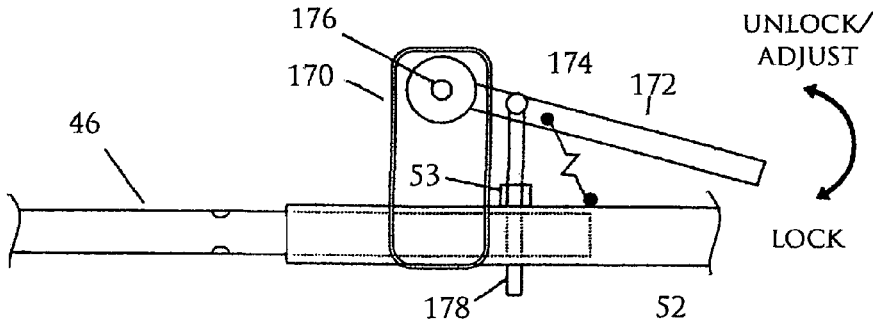
FIGS. 18, 18*a*, 18*b* diagrammatically illustrate a fifteenth locking/unlocking adjustment mechanism of my new walker.
Figure 18A:
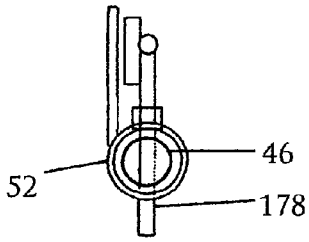
Figure 18B:
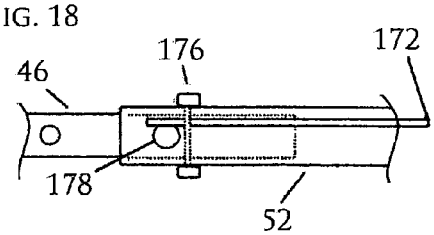

FIGS. 18, 18*a*, 18*b* shows an embodiment wherein a bracket 170 extends upward from telescoping tubes 46, 52, bracket 170 supporting a handle 172 downwardly biased by a spring 174. Handle 172 is supported for rotation about an axle or pivot 176, and is connected to a locking pin 178 that may be engaged/disengaged from tubes 46, 52 via openings therein in order to lock/unlock tubes 46, 52, respectively. A guide 53 may be used to prevent pin 178 from becoming misaligned from openings in tubes 46, 52 when the pin is retracted, and pin 179 may be shortened to only extend through one side of tubes 46, 52 as shown by dashed lines (FIG. 18).

Figure 19:
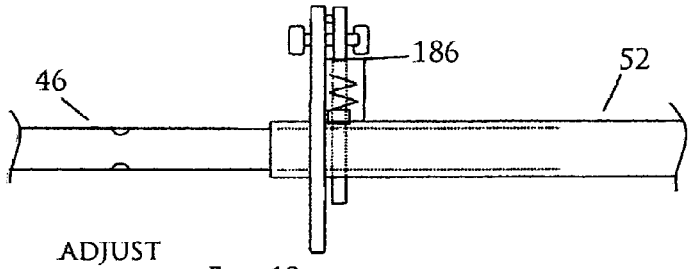
FIGS. 19, 19*a*, 19*b* diagrammatically illustrate a sixteenth locking/unlocking adjustment mechanism of my new walker.
Figure 19A:
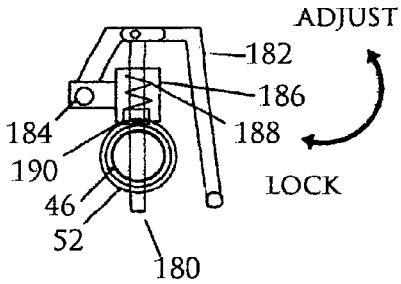
Figure 19B:
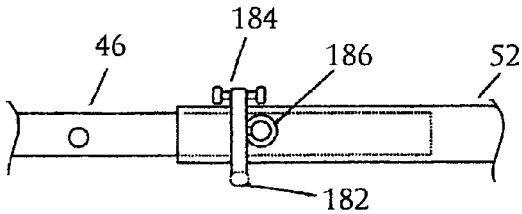

In a similar embodiment as shown in FIGS. 19, 19*a*, 19*b*, a locking pin 180 is supported as shown by a handle 182 having an offset pivot 184 extending to a side of a housing 186 that may be provided with opening or guides that stabilize and guide pin 180 into and out of openings in tubes 46, 52. Pin 180 is further connected at an upper end to handle 182 by a sliding pin-and-groove connection such that pin 180 is maintained in a withdrawn position when handle 182 is fully raised and positioned to a side of housing 186. A compression spring 188 is mounted between a collar 190 on pin 180, and applies a bias between collar 190 and an interior distal end of housing 186. As with other embodiments, length of pins 178, 180 may be such so as to extend through both sides of tubes 46, 52, or extend only through an upper side of tubes 46, 52, as shown by dashed lines in FIG. 19*a*.

Figure 20:
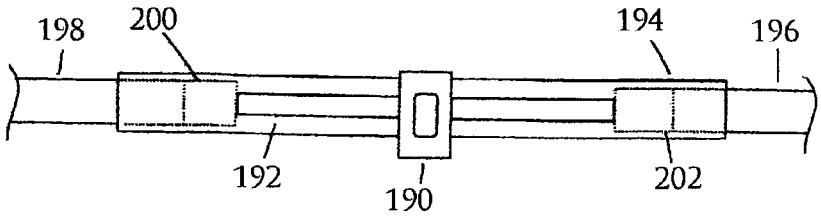
FIGS. 20, 20*a*, 20*b* diagrammatically illustrate a seventeenth locking/unlocking adjustment mechanism of my new walker.
Figure 20A:
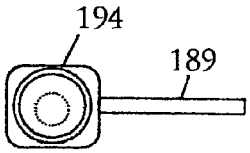
Figure 20B:
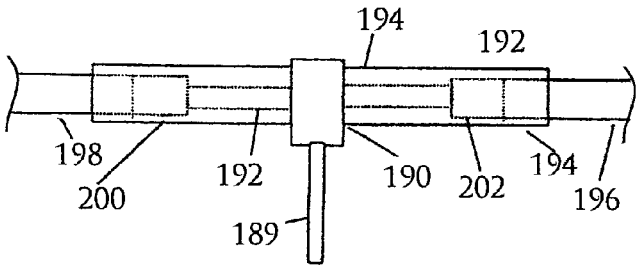

FIGS. 20, 20*a*, 20*b* shows an adjustment mechanism wherein either a hand-operated handle 189 or a motor 190 utilizing a threaded rod or leadscrew and worm arrangement, may be used to rotate a threaded rod or lead screw 192, handle or motor 190 mounted to an outer tube 194 that telescopingly receives at opposite ends tubes 196, 198 of a crossbar of a walker. Tubes 196, 198 each have a threaded end region 200, 202 that each threadably engage rod or lead screw 192, with the thread direction of the lead screw engaging portion 200 being opposite to the direction of the thread engaging portion 202. With this construction, when handle 189 is rotated or motor 190 is operated, turning the worm engaging threaded rod or lead screw 192, tubes 196, 198 are concurrently moved in either inward or outward directions to reduce or extend width of a walker.

Figure 21:
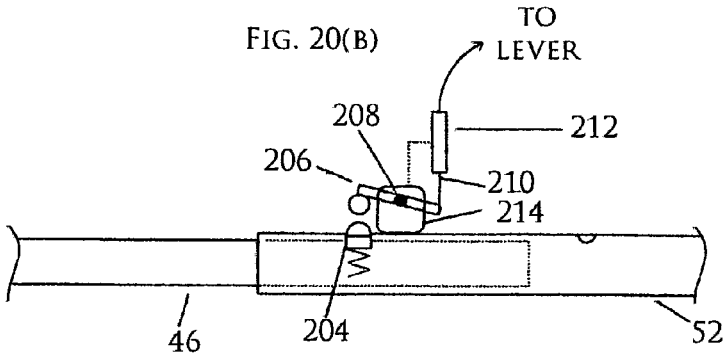
FIGS. 21, 21*a*, 21*b* diagrammatically illustrate an eighteenth locking/unlocking adjustment mechanism of my new walker.
Figure 21A:
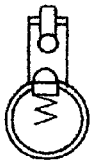
Figure 21B:
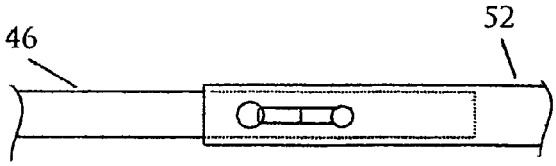

FIGS. 21, 21*a* and 21*b* shows a detent mechanism 204 mounted in a tube 46 and extending through an opening in tube 52, and operated by one end of a lever 206 supported for rotation about a pivot point 208, with the opposite end of the lever connected to a cable 210 in a cable housing 212, in turn supported by a bracket 214 that also supports lever 206. A hand lever (not shown) may be mounted in a location, such as proximate a handgrip of the walker, so as to be conveniently operated by a user while using the walker. Such a hand lever and associated cable 210 and housing 212 would be the same as or similar to a hand lever for operating a brake on a bicycle. In use, a user would merely operate the hand lever to unlock tubes 46, 52 in order to narrow a width of the walker.

Figure 22:
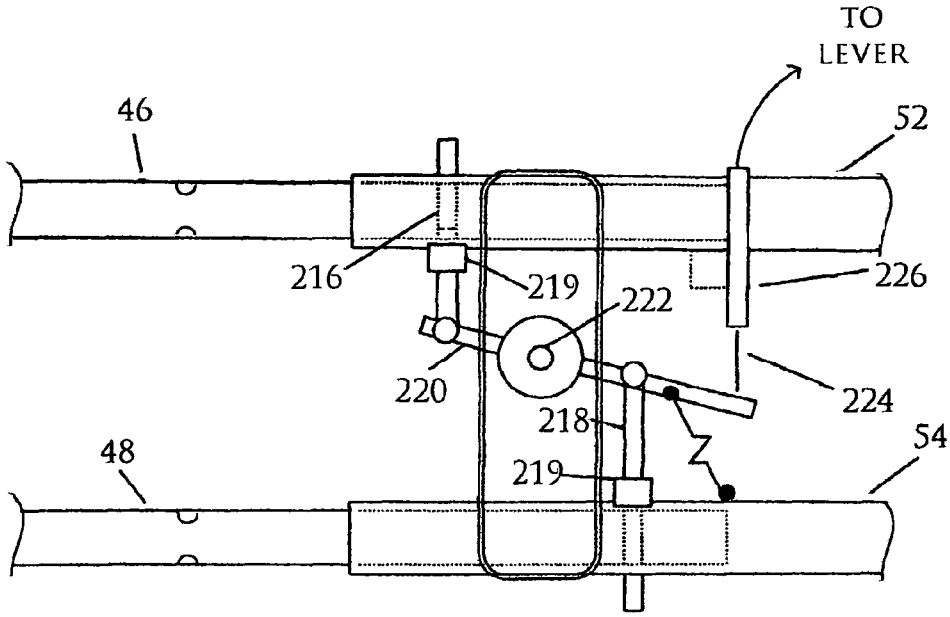
FIG. 22 diagrammatically illustrates a nineteenth locking/unlocking adjustment mechanism of my new walker.

FIG. 22 shows a similar arrangement wherein a pair of locking pins 216, 218 supported at each end of a lever lockably engage telescoping tubes 46, 52, and 48, 54, respectively. Pins 216, 218 may be stabilized by guides 219 mounted coaxial with openings in tubes 52, 54 so that the pins would not become misaligned when retracted from corresponding openings in tubes 46, 48. Lever 220 is rotatably supported by an axle or pivot point 222, and operated as described above by a cable in a housing 226 supported by a mount (not shown) on tube 52. A bicycle brake-type hand lever conveniently mounted so that the user could operate the lever while using the walker would be connected to cable 224. As shown by dashed lines, pins 216, 218 need not extend through both sides of tubes 46, 52 and 48, 54, but only need to extend through one side of the tubes.

Figure 23:
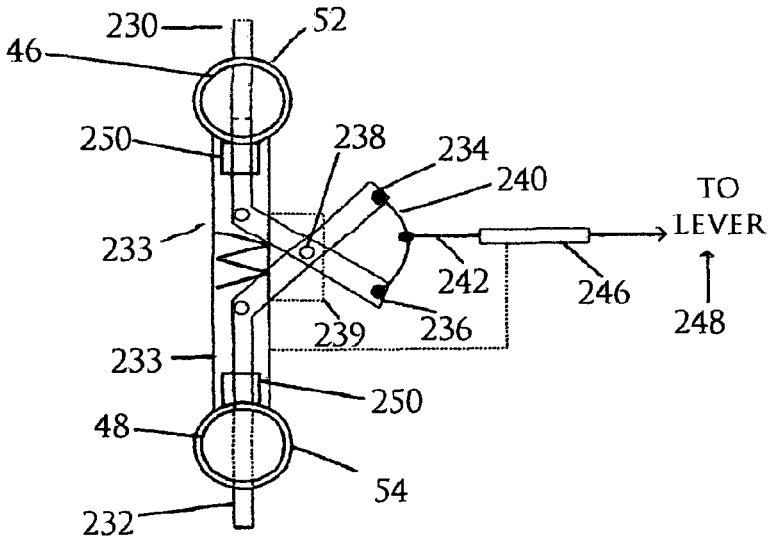
FIG. 23 diagrammatically illustrates a twentieth locking/unlocking adjustment mechanism of my new walker.

FIG. 23 shows an adjustment mechanism wherein a pair of pins 230, 232 biased apart by a compression spring 233, and are connected in pivoting relation to ends of a pair of levers 234, 236. Pins 230, 232 may be disposed in a tubular housing 233 between outer tubular members 52, 54, with a slot through which levers 234 and 236 extend. Levers 234, 236 may be centrally connected at a common pivot point 238 to a bracket or the like 239, with a wire or the like 240 connected between opposite ends of levers 234, 236. A cable 242 is connected generally at a center of wire 240, with the wire housed in a cable housing 246, with an opposite end of the cable and housing connected to a bicycle brake-type lever 248 that may be mounted near a handle or grip of the walker. In this embodiment, operation of handbrake 248 draws cable 240 to the right, in turn operating levers 234, 236 to pull pins 230, 232 toward each other against the bias of spring 233, and withdrawing pins 230, 232 from respective openings in tubes 46, 52 and 48, 54. Pin guides 250 coaxial with openings in the tubes may be used to prevent pins 230, 232 from becoming misaligned when withdrawn from the tubes. As with all other embodiments. Pins 230, 232 may be shortened as shown by dashed lines so that they only extend through one side of tubes 46, 52 and 48, 54 when retracted by the hand lever.

Figure 24:
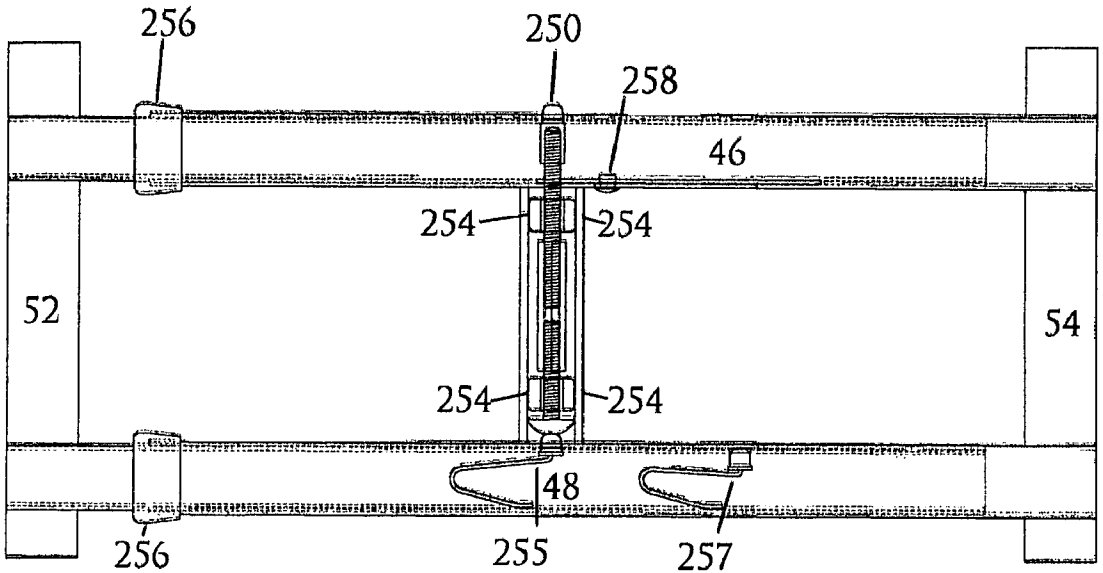
FIG. 24 diagrammatically illustrates a twenty-first locking/unlocking adjustment mechanism of my new walker.

FIG. 24 shows another embodiment wherein telescoping bars 52, 54 are locked and unlocked by a detent mechanism wherein a threaded rod 250 is supported in a tube 252 extending between tubes 52, 54 and 46, 48. Guides 254 at upper and lower ends of tube 252 stabilize rod 250 during operation. Rod 250 terminates at an upper end thereof with a detent cap 256, and at a lower end with a detent cap 258. Cap 258 bears on a first detent and spring assembly 260 mounted within tube 48, the first detent assembly positioned in and extending through an opening in both tubes 48, 52. A second detent assembly is also mounted in tube 48, and extends into an opening as shown in tube 48. In operation, the first detent assembly locks the walker together at the normal, wider width, and when it is desired to adjust the walker to the narrower width, detent cap 256 is pressed to push the detents 256, 260 into the tubes 46, 52, 48, 54, allowing tubes 46, 48 to be moved into tubes 2,4, respectively.

Having thus described my invention and the manner of its use, it should be apparent to those skilled in the relevant arts that incidental changes may be made thereto that fairly fall within the scope of the following appended claims, wherein I claim:

The invention claimed is:

1. A walker comprising:

a first side and a second side, two crossbars connected between said first side and said second side, each crossbar of said two crossbars further comprising:

a first member connected to said first side and a second member connected to said second side, said first member and said second member slidably disposed to be moved inwardly and outwardly with respect to each other, thereby narrowing or widening said walker a locking mechanism comprising selective locking means connected between the first member and the second member of said two crossbars for selectively locking the first member and the second member of said two crossbars together, locking the first side and the second side at a first, normal width usable by a person in need of assistance by the walker, the selective locking means being unlockable to allow the first member and the second member of said two crossbars to be moved to a second, narrower width, configuring the walker to a narrower width usable by a person in need of assistance by the walker to allow a person in need of assistance by the walker to use the walker in its normal manner while passing through a door or passageway narrower than said first width.

2. A walker as set forth in claim 1 wherein said selective locking means is lockable at the second width to lock the first side and the second side at the second, narrower width.

3. A walker as set forth in claim 1 wherein the first member and the second member each further comprise a first tubular member and a second tubular member, said first tubular member and the second tubular member being slidably disposed one within the other.

4. A walker as set forth in claim 1 wherein said first, normal width is between about 19 inches to about 21 inches, and said second, narrower width is about 16 inches to about 17 inches.

5. A walker as set forth in claim 1 wherein said first member and said second member of said two crossbars each has a first opening so that when each said first opening is in aligned relation, said first side and said second side are positioned at said first, normal width, and each said first member and each said second member of said two crossbars each further has a second opening so that when each said second opening is in aligned relation, said first side and said second side of said walker are positioned at said second, narrower width, said selective locking means connected between said two crossbars further comprising:

at least one pin for selectively engaging each said first opening and each said second opening, means coupled to said at least one pin, and operable by a single hand of a user of said walker, for disengaging or engaging said at least one pin from or with, respectively, each said first opening or each said second opening, allowing said walker to be adjusted to said first, normal width or to said second, narrower width while said walker is being used.

6. A walker as set forth in claim 1 wherein each said first member and each said second member of said two crossbars has a first opening so that when each said first opening is in aligned relation, said first side and said second side are positioned at said first, normal width, and said first member and said second member of said two crossbars each further has a second opening so that when each said second opening is in aligned relation, said first side and said second side of said walker are positioned at said second, narrower width, said selective locking means connected between said two crossbars further comprising:

a connecting member extending between and connecting together said two crossbars, a pin for each of said crossbars, each said pin selectively engaging each said first opening in each of said first and second members or each said second opening in each of said first and second members, means associated with said connecting member and each said pin, and operable by a single hand of a user of said walker, for disengaging or engaging each said pin from said first opening or said second opening, allowing said walker to be adjusted to said first, normal width or to said second, narrower width while said walker is being used.

7. A walker as set forth in claim 6 wherein said means associated with said connecting member and each said pin further comprises at least one hand-operated lever rotatably attached at a pivot point to said connecting member, with a first said pin rotatably mounted to said lever on one side of said pivot point and a second said pin rotatably mounted on the other side of said pivot point so that said first pin and said second pin is either withdrawn or inserted into said first openings or said second openings upon operation of said hand-operated lever.

8. A walker as set forth in claim 7 further comprising a cable attached at one end to said lever, and a hand-operated bicycle handbrake-type lever attached to the other end of said cable, said bicycle handbrake-type lever mounted to said walker at a convenient location so that a user of said walker may operate said lever and said first pin and said second pin to adjust width of said walker by operating said handbrake-type lever while using said walker.

9. A walker as set forth in claim 6 wherein said first opening in said two crossbars are in coaxial relation, and said second opening in said two crossbars are in coaxial relation, and each said pin is mounted in coaxial relation, each said pin further comprising:

a handle on each said pin, said handle extending generally normal from said connecting member, a spring between each said pin, said spring biasing said pins apart and into said first opening or said second opening, whereby when said handles are brought together, as when squeezed together by a user, said pins are withdrawn from respective ones of said first opening or second opening, allowing a width of said walker to be adjusted.

10. A walker as set forth in claim 1 wherein said locking mechanism further comprises:

a spring within said at least one crossbar for biasing said first member and said second member apart to said first, normal width, a lever coupled between said first member and said second member for moving said first member and said second member together to said second, narrower width against the bias of said spring, said lever operable by a single hand of a user, a selectively operable latch for maintaining said second, narrower width of said walker against the bias of said spring, or releasing said first and second members to said first, normal width with the bias of said spring.

11. A walker as set forth in claim 1 wherein said locking mechanism further comprises:

a rod having oppositely threaded regions along opposed ends, a threaded region at an end of each of said first member and said second member, each said threaded region of the first member and second member threadably receiving a respective threaded end of said rod, a drive mechanism attached to said rod, for rotating said rod, thereby moving said first member and said second member in opposite directions, adjusting a width of said walker.

12. A walker as set forth in claim 11 wherein said drive mechanism is a motor.

13. A walker as set forth in claim 11 wherein said drive mechanism is a lever attached to said rod.

* * * * *